US005577851A

United States Patent [19]

Koptis

[11] Patent Number: 5,577,851

[45] Date of Patent: Nov. 26, 1996

[54] TUBE DISPENSER WITH SPONGE APPLICATOR

[75] Inventor: Kurt Koptis, Yucca Valley, Calif.

[73] Assignee: Painter's Products Inc., Palm Desert, Calif.

[21] Appl. No.: 22,077

[22] Filed: Feb. 24, 1993

[51] Int. Cl.[6] ..... B43K 1/00

[52] U.S. Cl. ..... 401/202; 401/207; 401/265; 401/266; 401/183

[58] Field of Search ..... 401/202, 207, 401/196, 265, 266, 134, 183–6

[56] References Cited

U.S. PATENT DOCUMENTS

| | | | |
|---|---|---|---|
| 1,007,492 | 10/1911 | Ruch | 401/262 |
| 3,072,953 | 1/1963 | Bunke | 401/262 X |
| 3,106,742 | 10/1963 | Schultz et al. | 401/202 |
| 3,214,780 | 11/1965 | Sharpe | 401/185 X |
| 3,271,810 | 9/1966 | Raffe | 401/266 X |
| 3,756,732 | 9/1973 | Stöffler | 401/202 |
| 3,797,946 | 3/1974 | Witzmann et al. | 401/266 X |
| 3,922,099 | 11/1975 | Christine et al. | 401/134 |
| 4,271,982 | 6/1981 | Niksich et al. | 401/134 X |
| 4,848,946 | 7/1989 | Goncalves | 401/183 X |
| 4,887,924 | 12/1989 | Green | 401/266 X |
| 5,042,690 | 8/1991 | O'Meara | 401/134 X |

FOREIGN PATENT DOCUMENTS

| | | | |
|---|---|---|---|
| 1124161 | 6/1956 | France | 401/266 |
| 1411630 | 4/1969 | Germany | 401/202 |

*Primary Examiner*—Danton D. DeMille

*Attorney, Agent, or Firm*—Charles H. Schwartz; Ellsworth R. Roston

[57] ABSTRACT

A tube dispenser, sponge applicator and cover assembly including a tube dispenser having a main body portion, an upper neck portion extending from the main body at an upper end and an upper circumferential portion at the upper end of the main body portion adjacent to the-neck portion. A sponge applicator for attachment around the neck portion of the tube dispenser for applying any substance contained in the tube dispenser. A cover member having an upper portion for covering the sponge applicator and the neck portion of the tube dispenser and a lower circumferential portion to mate with and seal to the upper circumferential portion of the main body of the tube dispenser.

6 Claims, 1 Drawing Sheet

FIG. 1
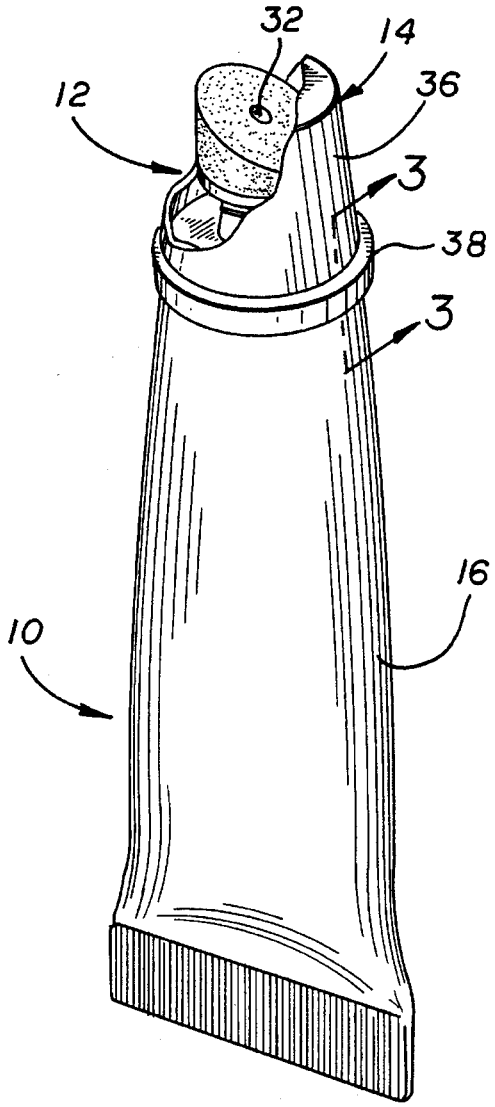
FIG. 2
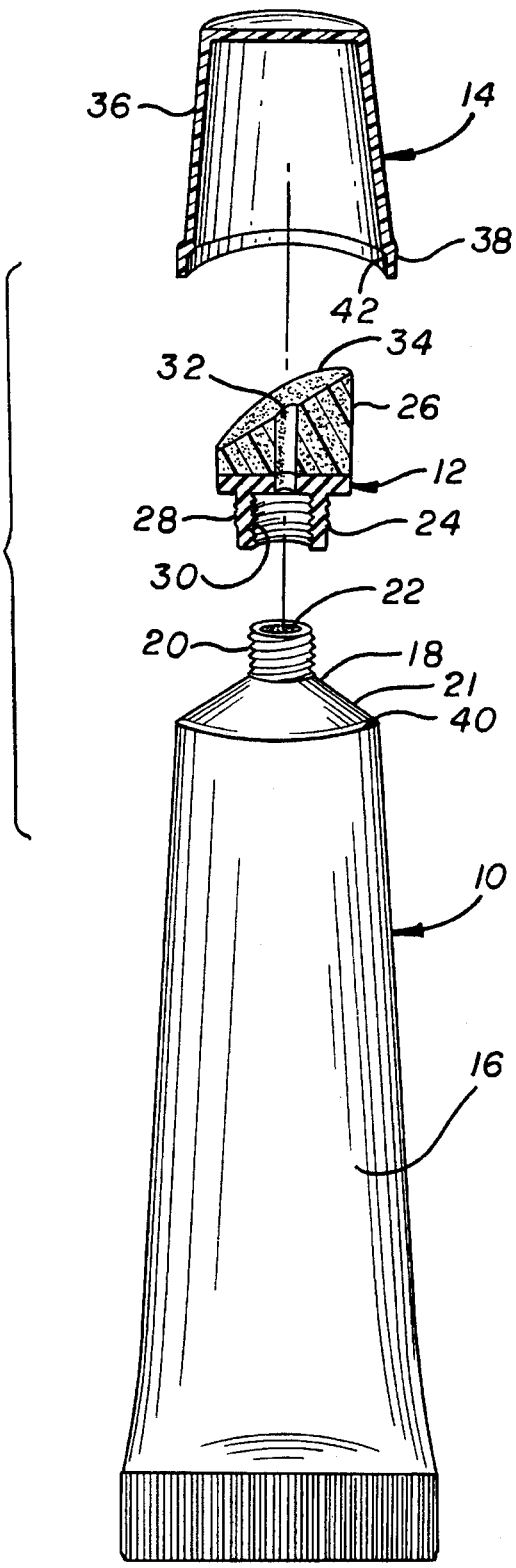
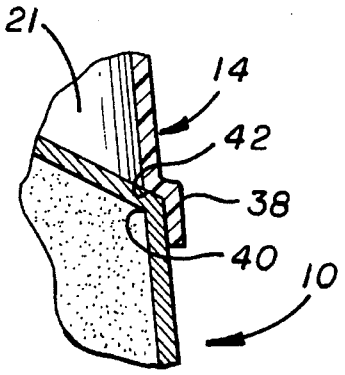
FIG. 3

TUBE DISPENSER WITH SPONGE APPLICATOR

BACKGROUND OF THE INVENTION

The present invention relates to a tube dispenser with sponge applicator and specifically to a tube dispenser with sponge applicator that has a cover member to seal off the contents of the tube dispenser when not in use.

In the prior art, tube dispensers have been known, which serve as containers for a variety of substances. The substance may be dispensed from the container by deforming the container walls so as to force the contents of the container through an aperture at one end of the container. The most common tube dispenser of this type is a tube of toothpaste. In addition, tube dispensers have been provided which include an applicator device mounted around the aperture. When the contents of the tube are dispensed through the aperture, the applicator is then used to apply the contents of the tube to a desired surface.

For example, in the past, structures of the above described type have been used to apply a liquid dressing or polish to leather such as shown in Albert U.S. Pat. No. 2,870,471, Fagan U.S. Pat. No. 3,023,448 and Schultz et al U.S. Pat. No. 3,106,742. Other applicators which have been used in the prior art are again directed to the application of a liquid from the tube container to a surface such as shown in Schwartzman U.S. Pat. No. 3,565,294 and Johnson U.S. Pat. No. 3,811,783.

Hulsh U.S. Pat. No. 3,121,906 shows a similar tube applicator for dispensing and applying the contents of a container which are more viscus than those described in the patents referred to above. Specifically, the Hulsh patent relates to paste and viscus substances such as an oven cleaning composition. The present invention is more generally directed to a tube dispenser with sponge applicator of the type shown in the Hulsh patent in that it is more directly applicable to a paste-like substance and specifically a spackle compound used to fill holes in walls and ceilings prior to painting.

Also in the prior art are various devices used by plasterers to provide for the application of plaster material on a continuous basis such as shown in the Martin U.S. Pat. No. 2,864,109, the Anderson U.S. Pat. No. 2,882,716 and the Etens U.S. Pat. No. 3,368,234. These types of devices are directed to a different area than the present invention since they relate to the spreading of plaster material to much larger areas than would be practical with the present invention.

The devices of the prior art suffer from a number of deficiencies including complexity in construction and difficulty in reusing since the prior art devices are often poorly sealed once they have been opened. For example, the Hulsh patent has a snap-on cover which attaches to a portion of the sponge applicator assembly. Both the cover and sponge applicator are complicated in structure and thereby relatively expensive to produce. In addition, the cover seals so poorly that a separate closure cap must be used to seal off the contents of the tube container once the container has been opened and used.

Many of the other prior art patents include screw type covers which are again more complex in structure and would not provide for a good seal once the tube dispenser has been used. The Schwartzman patent also has a snap-on cap or cover which cooperates with a portion of the applicator structure and again is generally complex in construction and thereby expensive.

SUMMARY OF THE INVENTION

In the present invention a very simple assembly of a tube dispenser, sponge applicator and cover member is provided. Specifically, the tube dispenser does not require any special closure cap, but actually includes a cutoff tip so that prior to cutting off this tip the contents of the tube dispenser are completely sealed and not in any way exposed to the environment. The sponge applicator has a specific angle design to facilitate the application of the paste material, such as a spackle compound, and with the sponge applicator attached to the top of the tube dispenser surrounding a dispensing aperture.

In the particular example shown in the present application, the applicator is attached by a threaded connection to a neck portion at the top of the tube dispenser. Finally, the cover member is very simple in construction and is specifically designed to seal the tube dispenser and sponge applicator by seating onto a circumferential portion at the upper end of the tube dispenser. In the present invention, the cover member does not seal to a portion of the sponge applicator. The cover member is independent of the sponge applicator, and seals around the upper circumferential portion of the tube dispenser itself.

The cover structure is very simple in construction and provides for an air tight seal because of the nature of the materials used for the cover member and the tube dispenser. Specifically, the cover member is made out of a substantially stiff material such as a hard plastic material, while the tube dispenser is made out of a pliable plastic material which is much more flexible than the cover member. When the cover member is positioned around the upper end of the tube dispenser the upper circumferential will deform sufficiently for the cover member to provide for a tight sealing area around the upper end of the tube. The present invention therefore provides for a simple structure which completely seals the contents of the tube dispenser before use, and allows for a resealing of the assembly if the contents are only partially used. This is accomplished using a simple and inexpensive cover member which seals directly onto an upper circumferential portion of the tube dispenser.

A BRIEF DESCRIPTION OF THE DRAWINGS

FIG. 1 is a perspective view of a tube dispenser, sponge applicator and cover assembly of the present invention and with the cover member shown partially broken away to illustrate the sponge applicator;

FIG. 2 is an exploded view of the assembly of FIG. 1 and with the cover member and sponge applicator shown in cross section; and FIG. 3 is a cross-sectional view taken along lines 3—3 of FIG. 1 in illustrating the sealing of the cover member to an upper circumferential portion of the tube dispenser.

DESCRIPTION OF THE PREFERRED EMBODIMENT

Referring specifically to FIGS. 1–3, it can be seen that the assembly of the present invention is composed of three inter-related parts. These parts are the squeezable tube dispenser 10, a sponge applicator 12, and a cover member 14. The sponge applicator 12 is shown to be secured to the top of the tube dispenser 10 using a screw thread arrangement and with the cover 14 covering the top of both the tube dispenser 10 and the sponge applicator 12 by sealing around an upper circumferential portion of the tube container 10.

The tube dispenser 10 includes a main body portion 16 surmounted at the top by a neck portion 18. The neck portion 18 includes a spiral exterior thread 20 and a closed tip portion 22 to provide for a seal of the contents of the main body portion 16 of the tube 10. The closed tip portion 22 may be cut off by a knife to dispense the contents of the tube until the tip 22 is cut off. The contents, such as a spackle compound, are sealed within the tube dispenser 10 and remain fresh and thereby storeable for a considerable period of time.

The sponge applicator 12 includes a lower rigid plastic portion 24 and an upper sponge member 26. The sponge member 26 may be attached to the lower plastic portion 24 such as by an adhesive. The lower portion 24 includes a cylindrical member 28 having a spiral interior thread 30 which mates with the spiral exterior thread 20 of the neck portion 18. It can be seen therefore that the sponge applicator 12 may be threaded onto the top of the tube dispenser 10. Finally, the sponge applicator 12 includes an opening 32 that extends through the sponge portion 26 and the substantially rigid portion 24 so that any contents of the container 10 may be squeezed through the neck 18 and through the opening 32 to be applied by the outer surface 34 of the sponge 26.

The cover member 14 is designed to cover the end of the tube dispenser 10 and the sponge applicator 12 and to reseal the tube dispenser. Specifically, when the end 22 of the neck 18 is cut off, the contents of the container 12 may be dispensed through and applied by the sponge applicator 12. Once the application has been completed then the cover 14 may be reinstalled as shown in FIGS. 1 and 3 so as to seal the upper end of the assembly of the present invention. The tube dispenser with sponge applicator may then be reused at a later time.

The cover 14 has an upper end 36 which covers the sponge applicator 12 and a lower end 38 which forms a rigid ring which is designed to seal against an upper circumferential portion 40 of the main body portion 16 of the tube dispenser 10. As can be seen in the drawings and specifically in FIG. 3, the lower portion 38 overlays and provides a friction fit to the upper circumferential portion 40 of the main body 16 of the tube dispenser 10. The lower end 38 of the cover 14 has a stepped design as shown by step 42 to act as a stop to limit the insertion of the cover 14 on the upper circumferential portion 40.

The container 10 is preferably formed of a relatively pliable plastic material whereas the cover member 14 and specifically the lower portion 38 are preferably formed of a somewhat stiffer material such as a hard plastic. The lower portion 38, which forms the substantially rigid ring, therefore provides a substantially air tight seal to the upper circumferential portion 40 and has a friction fit due to the interrelationship between the relatively pliable and relatively stiff plastic materials.

The applicator sponge 12, and specifically the sponge portion 26, may be formed from a spongy material, such as a foamed plastic material, so as to provide for the proper application of the contents of the tube dispenser 10. One specific material that the present invention is designed for is a spackle compound and with the assembly of the present invention thereby used to apply spackle material to holes or cracks in walls or ceilings and with the sponge applicator 12 then used to smooth off the spackle material to conform to the surrounding wall or ceiling and thereby provide a proper surface for painting.

Typically, after the present invention has been used, for example to apply spackle in a desired manner, the sponge assembly 12 may be thoroughly cleaned by flushing with running water so as to clean any excess spackle material out of the sponge material and out of the opening 32. This may be accomplished with the sponge applicator either separated from container 10, or with the sponge applicator still in position as long as excess water does not enter into the tube dispenser 10. Once the sponge applicator 12 has been thoroughly cleaned, then the cover member 14 may be friction fit onto the top of the tube dispenser to have the lower ring portion 38 of the cover 14 engage the upper circumferential portion 40 of the tube 10 as shown in FIGS. 1 and 3.

Although the present has been described with reference to a particular embodiment, it is to be appreciated that various adaptations and modifications may be made and the invention is only to be limited by the appended claims.

I claim:

1. A tube dispenser, sponge applicator and cover assembly wherein the tube dispenser is designed to contain a substance for application to an exterior surface including, a tube dispenser having a main tubular body portion, an upper neck portion extending inwardly from the upper end of the main tubular body portion for dispensing any substance within the main tubular body portion and a non-threaded upper circumferential portion at the upper end of the main tubular body portion and adjacent to the neck portion, said upper circumferential portion at the upper end of said main tubular body portion being a smooth continuation of said main tubular body portion, a sponge applicator for attachment around the neck portion of the tube dispenser for applying to the exterior surface the substance contained in the tube dispenser which has been dispensed through the upper neck portion and through the sponge applicator, a cover member having an upper portion for covering the sponge applicator and the neck portion of the tube dispenser and a non-threaded lower circumferential portion to provide a friction fit to mate with and seal, to the upper circumferential portion of the main body portion of the tube dispenser, wherein the cover member is formed of a relatively stiff material and the tube dispenser, and including said tubular main body portion and said upper circumferential portion is formed of a relatively pliable material and wherein said cover member is so dimensioned that the lower circumferential portion of the cover member forms a substantially rigid ring to provide the friction fit to mate with and seal to the outer surface of said relatively pliable upper circumferential portion of the main tubular body portion of the tube dispenser, and wherein the lower circumferential portion of the cover member has an inner step dimensioned to seat on the upper neck portion adjacent said upper circumferential portion at the upper end of the main tubular body portion and has a lower end forming said rigid ring engagable on the upper circumferential portion of the main tubular body portion to mate and seal with said outer surface of said upper circumferential portion, said inner step providing a stop to limit the insertion of the cover member on the upper circumferential portion of the main tubular body portion of the tube dispenser.

2. The assembly of claim 1 wherein the cover member and the tube dispenser are both formed of plastic material and with the cover member being a hard plastic material and the tube member being a pliable plastic material.

3. The assembly of claim 1 wherein the upper neck portion of the tube dispenser has a closed end which must be cut off or punctured in order to release the substance contained in the main body of the tube dispenser.

4. The assembly of claim 1 wherein the sponge applicator is attached around the neck portion of the tube dispenser and additionally including complementary threaded portions on an inside surface of the sponge member and an outside surface of the neck portion.

5. The assembly of claim 1 additionally including an opening extending through the sponge member to insure the easy passage of the substance contained in the main body of the tube dispenser and with the substance contained in the tube dispenser a paste-like substance.

6. The assembly of claim 5 wherein the paste-like substance contained in the tube dispenser is a spackle compound for use in patching holes and cracks in walls and ceilings.

* * * * *